US011745379B2

(12) United States Patent
Testoni et al.

(10) Patent No.: US 11,745,379 B2
(45) Date of Patent: Sep. 5, 2023

(54) CUTTING UNIT FOR THE CUTTING OF A SUBSTRATE BAND FOR AN AEROSOL-GENERATING DEVICE AND RELATED CUTTING ASSEMBLY

(71) Applicant: G.D SOCIETA' PER AZIONI, Bologna (IT)

(72) Inventors: Luca Testoni, Castelmaggiore (IT); Carlo Moretti, Bologna (IT); Simone Lazzaroni, Comacchio (IT); Luca Lanzarini, Crespellano (IT); Luca Federici, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 513 days.

(21) Appl. No.: 16/755,704

(22) PCT Filed: Oct. 18, 2018

(86) PCT No.: PCT/IB2018/058083
§ 371 (c)(1),
(2) Date: Apr. 13, 2020

(87) PCT Pub. No.: WO2019/077539
PCT Pub. Date: Apr. 25, 2019

(65) Prior Publication Data

US 2021/0197418 A1 Jul. 1, 2021

(30) Foreign Application Priority Data

Oct. 18, 2017 (IT) ..... 102017000117582

(51) Int. Cl.
*B26F 1/38* (2006.01)
*B26F 1/40* (2006.01)
(Continued)

(52) U.S. Cl.
CPC ..... *B26F 1/3846* (2013.01); *A24F 40/42* (2020.01); *A24F 40/70* (2020.01); *B26D 7/32* (2013.01);
(Continued)

(58) Field of Classification Search
CPC ..... B29C 69/005; B26F 1/3846; B26F 1/40; A24F 40/70; A24F 40/42; A24F 40/10; A24F 40/44; B26D 7/32
(Continued)

(56) References Cited

U.S. PATENT DOCUMENTS 2,603,391 A * 7/1952 Kaufman ..... A41D 27/26 223/54
3,066,562 A * 12/1962 Barnett ..... D06H 7/02 250/359.1
(Continued)

FOREIGN PATENT DOCUMENTS

WO WO-2012/152798 A1 11/2012
WO WO-2015/165815 A1 11/2015
(Continued)

OTHER PUBLICATIONS

International Application No. PCT/IB2018/058083, International Search Report and Written Opinion, dated Jan. 24, 2019.

*Primary Examiner* — Nhat Chieu Q Do
(74) *Attorney, Agent, or Firm* — Marshall, Gerstein & Borun LLP

(57) ABSTRACT

A cutting unit for the cutting of a substrate band for an aerosol-generating device, and a related cutting assembly, wherein the substrate band has a longitudinally-extending axis and wherein the cutting unit comprises: a feeder for feeding the substrate band along a feed direction parallel to the extension axis; a cutting head comprising a cutting edge having a closed profile for cutting a substrate portion from
(Continued)

the substrate band, which cutting head is movable in a movement direction transversal to the feed direction between a cutting position, in which it cuts the substrate portion, and a release position, in which it releases the substrate portion; and a conveyor, which are arranged and shaped so as to receive the substrate portion from the cutting head when the cutting head is in the release position, and convey the substrate portion towards an output section.

8 Claims, 7 Drawing Sheets

(51) Int. Cl.
*A24F 40/70* (2020.01)
*A24F 40/42* (2020.01)
*B26D 7/32* (2006.01)
*A24F 40/10* (2020.01)
*A24F 40/44* (2020.01)

(52) U.S. Cl.
CPC ..... *B26F 1/40* (2013.01); *A24F 40/10* (2020.01); *A24F 40/44* (2020.01)

(58) Field of Classification Search
USPC ..... 83/28, 100
See application file for complete search history.

(56) References Cited

U.S. PATENT DOCUMENTS 3,263,882 A * 8/1966 Petri ..... B26D 7/18 225/2
3,789,711 A * 2/1974 Mead ..... B65G 27/04 198/755
4,480,772 A * 11/1984 Gerndt ..... A41D 27/10 83/37
4,708,042 A * 11/1987 Jung ..... B21D 28/06 83/123
4,809,576 A * 3/1989 Bakermans ..... B21D 28/002 83/167
5,055,155 A * 10/1991 Crotty ..... B32B 38/185 156/380.7
5,382,404 A * 1/1995 Kogame ..... B28B 11/168 264/153
5,410,928 A * 5/1995 Bakermans ..... B26D 7/18 83/167
5,507,910 A * 4/1996 Miyajima ..... H05K 13/00 156/518
5,778,507 A * 7/1998 Grannan ..... H01H 13/7006 53/553
5,934,167 A * 8/1999 Yamamoto ..... G03B 27/462 83/210
6,435,067 B1 8/2002 Irwin
6,484,387 B1 * 11/2002 Lee ..... H02K 15/02 29/609
6,658,973 B1 * 12/2003 Sahm ..... B65G 21/2036 83/99
7,407,155 B2 * 8/2008 Tamura ..... G03G 15/6582 270/58.07
8,157,947 B2 * 4/2012 Kim ..... B29C 69/005 156/251
9,138,781 B1 * 9/2015 Strong ..... A22C 17/002

FOREIGN PATENT DOCUMENTS

WO WO-2017108415 A1 * 6/2017
WO WO-2017/186764 A1 11/2017

* cited by examiner

CUTTING UNIT FOR THE CUTTING OF A SUBSTRATE BAND FOR AN AEROSOL-GENERATING DEVICE AND RELATED CUTTING ASSEMBLY

CROSS-REFERENCE TO RELATED APPLICATIONS

This is the U.S. national phase of International Application No. PCT/IB2018/058083, filed Oct. 18, 2018, which claims the benefit of Italian Patent Application No. 102017000117582 filed on Oct. 18, 2017.

TECHNICAL FIELD

The present invention lies in the technical field relating to aerosol-generating devices. In particular, the present invention relates to a cutting unit for the cutting of a substrate band for an aerosol-generating device. Moreover, the present invention relates to a cutting assembly comprising said cutting unit.

PRIOR ART

As is known, aerosol-generating devices are made up of several components which must be appropriately assembled together. In particular, an aerosol-generating device can comprise: a cartridge containing a flavoured liquid; a substrate made of a flexible (non-rigid) material, which is capable of carrying the liquid by capillary action; an atomizer which heats the liquid carried by the substrate to generate aerosols; a rechargeable battery powering the atomizer.

The substrate, which has very small dimensions, is obtained starting from a substrate band that must be suitably cut and then assembled in the cartridge. Currently, the cutting of the substrate band is performed manually. This leads to inaccuracies in the formation of the substrate and high production times.

Moreover, the production of aerosol-generating devices and related cartridges is becoming increasingly automated; consequently, the manual production of the substrate makes it complex to transfer substrates (small substrates made of flexible material) to the component assembly stations of the aerosol-generating device.

Patent application WO2015165815A1 discloses a method for manufacturing a container provided with a heater for an aerosol-generating device.

U.S. Pat. No. 6,435,067B1 discloses a device for separating thermoformed articles from a continuous band of plastic or expanded material.

Patent application WO2012152798A1 describes a device for cutting a rod from a continuous band of porous material and then applying the rod to a filter component.

DESCRIPTION OF THE INVENTION

The object of the present invention is to overcome the aforesaid problems. This object is achieved by means of a cutting unit for the cutting of a substrate band for an aerosol-generating device and a related cutting assembly in accordance with the appended claims. Advantageously, the present invention allows a substrate band made of a flexible material to be cut in a quick and precise manner. Furthermore, the substrate portions exiting the cutting unit are arranged and oriented so as to be transferred to a successive assembly unit of the aerosol-generating device.

BRIEF DESCRIPTION OF THE DRAWINGS

The present invention will now be described with reference to the accompanying drawings, which illustrate a non-limiting embodiment thereof, in which.

PREFERRED EMBODIMENTS OF THE INVENTION

Figure 1:
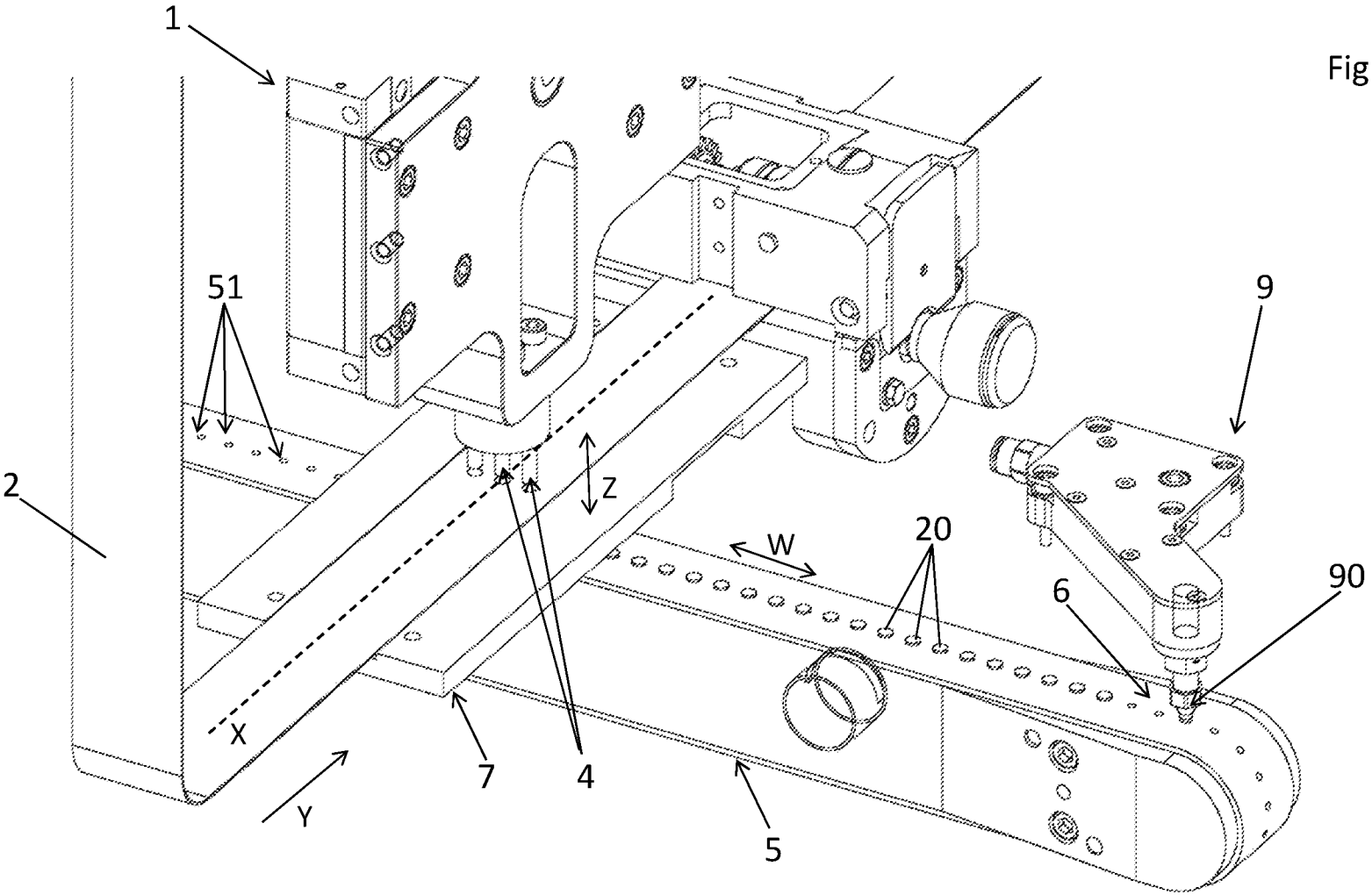
FIGS. 1 and 2 are respective perspective views of an embodiment of the cutting unit according to the present invention.
Figure 2:
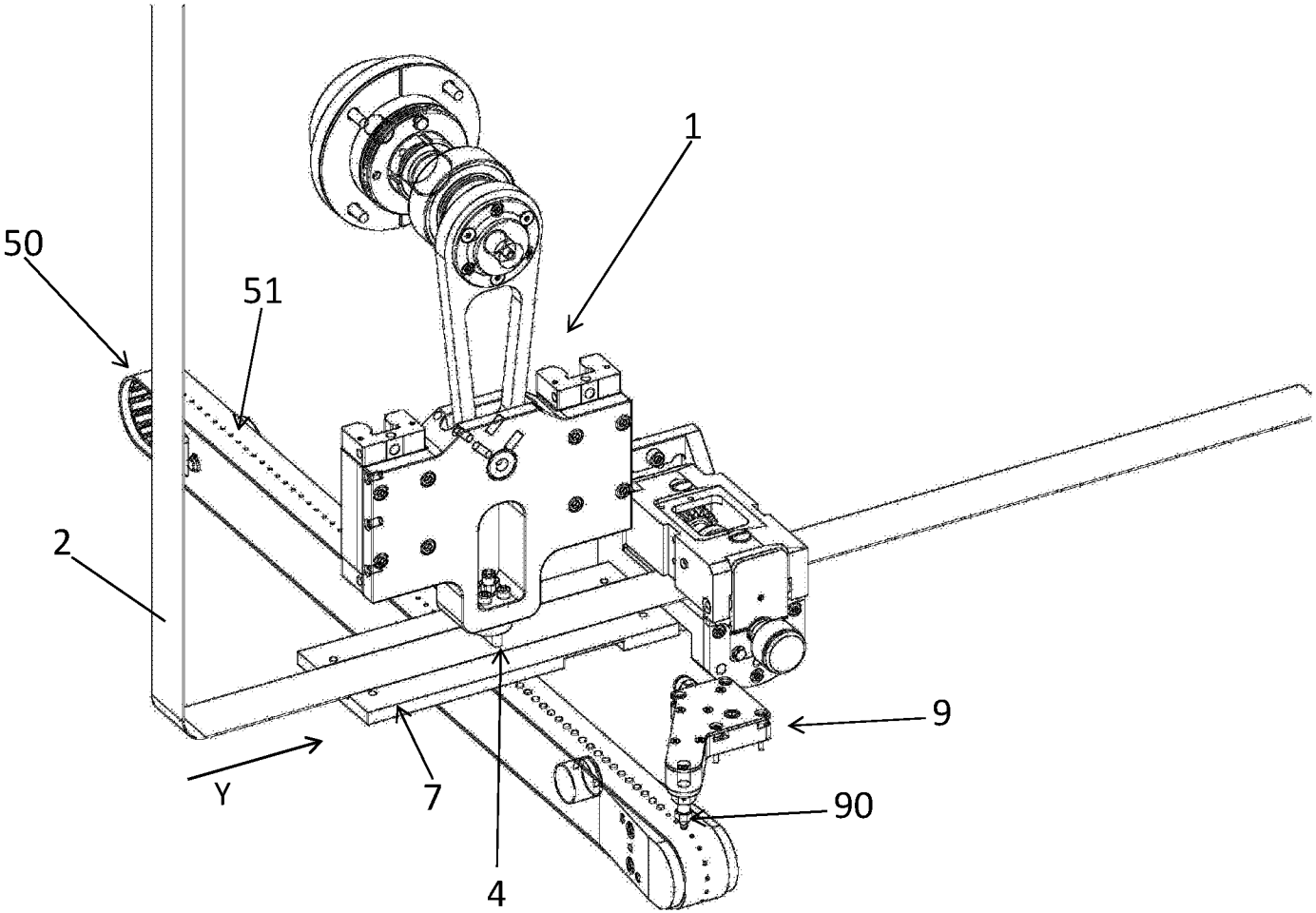

With reference to the accompanying figures, reference numeral 1 designates a cutting unit for the cutting of a substrate band for an aerosol-generating device and reference numeral 100 designates a cutting assembly comprising the aforesaid cutting unit 1.

The expression "substrate band", indicated with reference numeral 2 in the accompanying figures, is intended to mean a band made of a material suitable for carrying a liquid by capillary action. In this regard, the substrate band may be made of any material suitable for this purpose. For example, the substrate band 2 may have a spongy or fibrous structure. In any case, the substrate band 2 is flexible (i.e. it is not rigid). For example, the substrate band 2 may be made of a material comprising cellulose or polymeric material. For example, the substrate band 2 may be made of a material comprising wadding or paper or a super absorbent polymer. In accordance with a preferred embodiment, the substrate band 2 is made of cellulose acetate.

The substrate band 2 has a longitudinally-extending axis X. It is preferably unwound from a bobbin of substrate band.

One embodiment of the cutting unit 1 according to the present invention will be described hereinafter with reference to the accompanying drawings.

The cutting unit 1 comprises feed means 3 (FIG. 7) for feeding the substrate band 2 along a feed direction Y parallel to the extension axis X.

These feed means 3 may comprise several pulleys 30 whose rotation causes the feeding of the substrate band 2. It is understood that this is only a preferred embodiment, therefore these feed means 3 can be made with any other means known to a person skilled in the art.

With particular reference to the illustrated embodiment, the cutting unit 1 comprises three cutting heads 4, each comprising a cutting edge 40 having a closed profile for cutting a substrate portion 20 from the substrate band 2.

The three cutting heads 4 are movable in a movement direction Z transversal (preferably orthogonal) to the feed direction Y of the substrate band 2, between a cutting position, in which they cut the respective substrate portion 20, and a release position A (FIG. 6), in which they release the respective substrate portion 20.

In particular, with reference to the figures, the substrate band 2 comprises at least one horizontal segment at which the substrate portions 20 are formed; the movement direction Z of the cutting heads 4 is vertical (i.e. orthogonal to the horizontal segment of the substrate band 2).

The cutting unit 1 further comprises conveying means 5, which are arranged and shaped so as to receive the substrate portion 20 from each cutting head 4 when the cutting head 4 is in the release position A, and convey the substrate portions 20 towards an output section 6.

Advantageously, the proposed cutting unit 1 allows the substrate band 2 to be cut in a quick and precise manner. Furthermore, the substrate portions 20, through the conveying means 5, arrive at the output section 6 of the cutting unit 1: the substrate portions 20 are advantageously arranged so as to be transferred to a component assembly unit of the aerosol-generating device.

With particular reference to the accompanying figures, each cutting head 4 is movable in a movement direction Z parallel to the movement direction Z of the other cutting heads 4. In addition, the cutting heads 4 are moved synchronously with each other.

In addition, still in accordance with the embodiment of the cutting unit 1 shown in the figures, the three cutting heads 4 are mutually aligned in a line orthogonal to the feed direction Y of the substrate band 2.

It is to be understood that the cutting unit 1 may comprise a different number of cutting heads 4 without thereby departing from the scope of protection of the invention. For example, the cutting unit 1 could comprise a single cutting head 4 or more than three cutting heads 4. In addition, the cutting heads 4 could be arranged according to different patterns with respect to the illustrated one. For example, according to an embodiment, not shown, the cutting unit 1 could comprise nine cutting heads 4 arranged in a three-by-three array.

The cutting heads 4 can be shaped like tubular elements with the cutting edge 40 at one end thereof.

The substrate portion 20 usually has the shape of a small disk or a quadrilateral with an area ranging between 20 $mm^2$ and 30 $mm^2$.

With reference to the figures, the cutting edge 40 is circular. It may have a radius of between 2 mm and 3.5 mm. Alternatively, the cutting edge 40 could be a quadrilateral (for example, a square or a rectangle). It could have sides of length between 4 mm and 6 mm.

Figure 3:
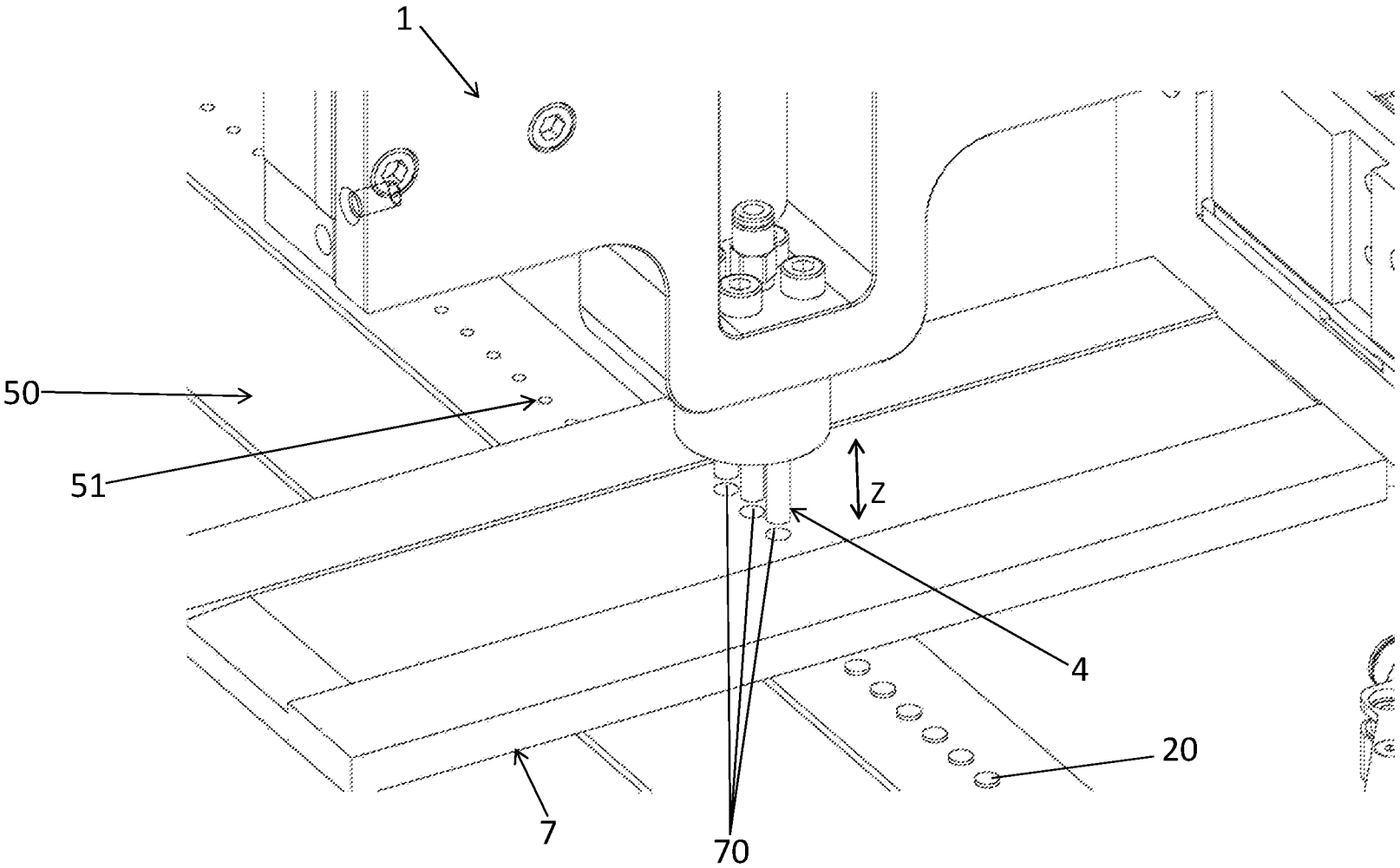
FIG. 3 is an enlarged detail of the cutting unit of FIG. 1 in which the substrate band has been omitted to better highlight other parts of the cutting unit.

With particular reference to FIG. 3, the cutting unit 1 may comprise a support plate 7 for supporting the substrate band 2. It is preferably arranged in a horizontal plane (orthogonal to the movement direction Z).

This support plate 7 comprises three through holes 70, each aligned with a respective cutting head 4 (i.e. aligned with the movement direction Z of the respective cutting head 4) and sized so as to be passed through by said respective cutting head 4. It is understood that the number of through holes 70 is equal to the number of cutting heads 4.

The support plate 7 is arranged between the substrate band 2 and the conveying means 5 so that the cutting head 4 passes through the through hole 70 when it is moved along the movement direction Z. In particular, each cutting head 4 passes through the corresponding through hole 70 when it is moved from the cutting position to the release position A, and vice versa.

The support plate 7 ensures a precise cut of the substrate band 2: advantageously, the substrate portion 20 obtained has a sharp edge.

Still with reference to FIG. 3, the cross section of each of the through holes 70 has a profile with the same shape as the closed profile of the cutting edge 40. Advantageously, the support plate 7 acts in opposition to the cutting heads 4.

In other words, each through hole 70 is defined by a side wall having a cross section defining a closed profile identical to the closed profile of the cutting edge 40.

Figure 5:
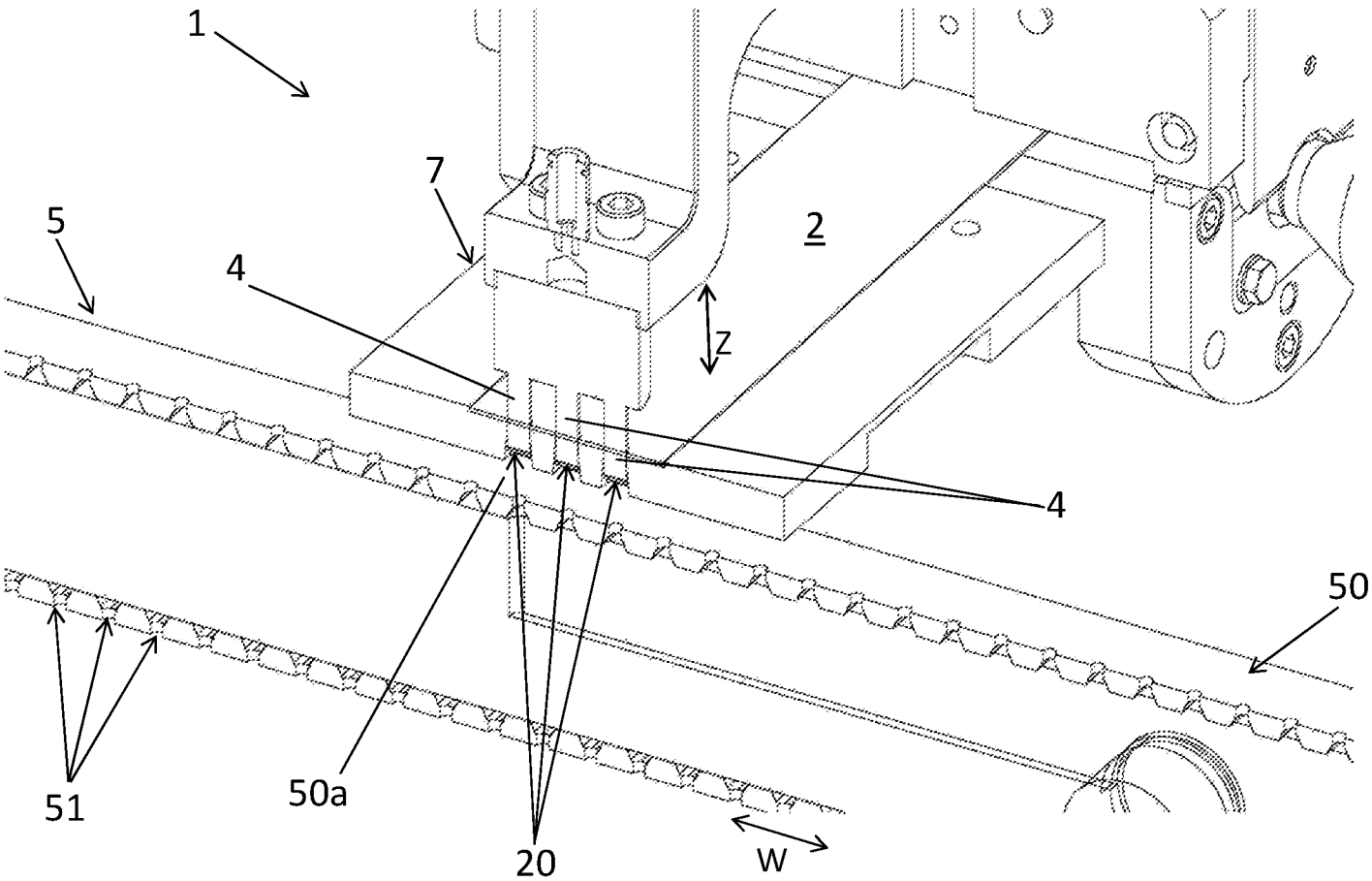

The cutting heads 4 are preferably suction heads. Advantageously, when moved from the cutting position to the release position A, they retain the substrate portion 20 so as to ensure a correct orientation of the substrate portion 20 on the conveying means 5 (FIG. 5).

The conveying means 5 may comprise a conveyor belt 50 (or a carrying strap) comprising a release segment **50*a* at which it receives the substrate portion 20 from the cutting head 4. The release segment 50*a* extends in a plane orthogonal to the movement direction Z of the cutting head 4 (the release segment 50*a*** is preferably horizontal).

In particular, the conveyor belt 50 is a closed-loop belt.

The conveying means 5 are arranged below the support plate 7. In addition, the release segment **50*a* is in a plane parallel to the substrate band 2**.

The conveyor belt 50 is preferably of the suction type (i.e. it is subjected to a suction source, not shown). In particular, with reference to the attached figure, the conveyor belt 50 comprises a plurality of suction holes 51 mutually aligned along the extension of the conveyor belt 50. In detail, when the three cutting heads 4 are in the release position A, three suction holes 51 of the conveyor belt 50 are each aligned with a respective cutting head 4 (i.e. with the movement direction Z of the corresponding cutting head 4).

Therefore, each substrate portion 20 obtained is released at a suction hole 51 of the conveyor belt 50. Advantageously, the correct positioning of the substrate portions 20 on the conveyor belt 50 is ensured during their conveyance towards the output section 6.

It is understood that the conveyor belt 50 may comprise a different number of suction holes 51 with respect to those illustrated. Moreover, said suction holes 51 could be arranged in a different manner from that shown herein without thereby departing from the scope of protection of the invention.

Alternatively to what has been described previously, the conveyor belt 50 can be made of an air-permeable material (and therefore may not necessarily require the presence of the suction holes 51), or it may have a mesh-like conformation.

With particular reference to FIG. 1, the conveying means 5 convey the substrate portions 20 in a plane parallel to the substrate band 2 and in a conveying direction W transversal (in particular, orthogonal) to the feed direction Y of the substrate band 2. Advantageously, such an arrangement of the conveying means 5 allows particularly small sizing of the cutting unit 1.

The cutting unit 1 may comprise, downstream of the cutting heads 4, means for discarding the substrate band 2. These discarding means can rewind the waste of the substrate band 2 back into a bobbin or can shred it.

Figure 6:
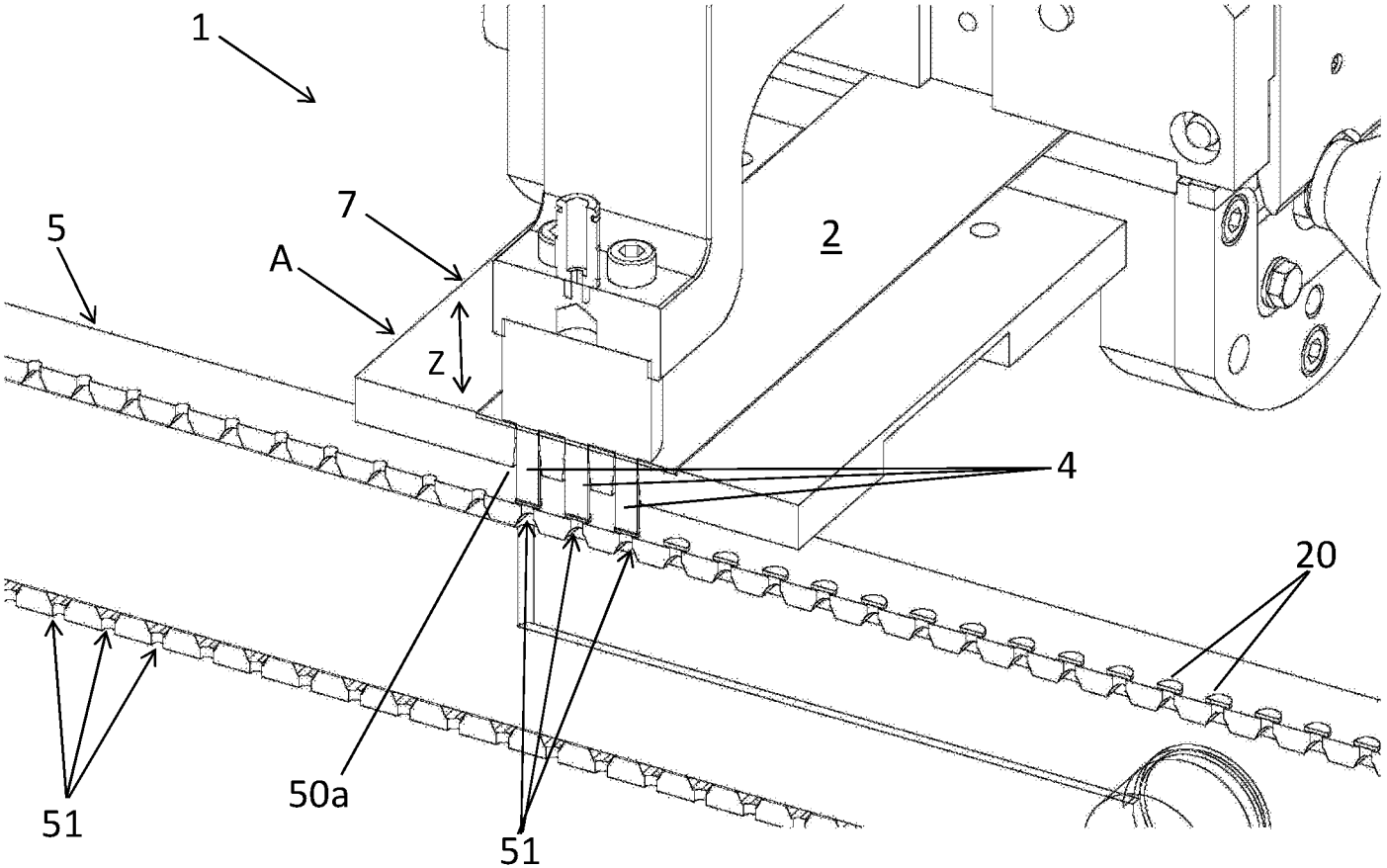

A working cycle of the cutting unit 1 is described below with reference to FIGS. 4-6.

Figure 4:
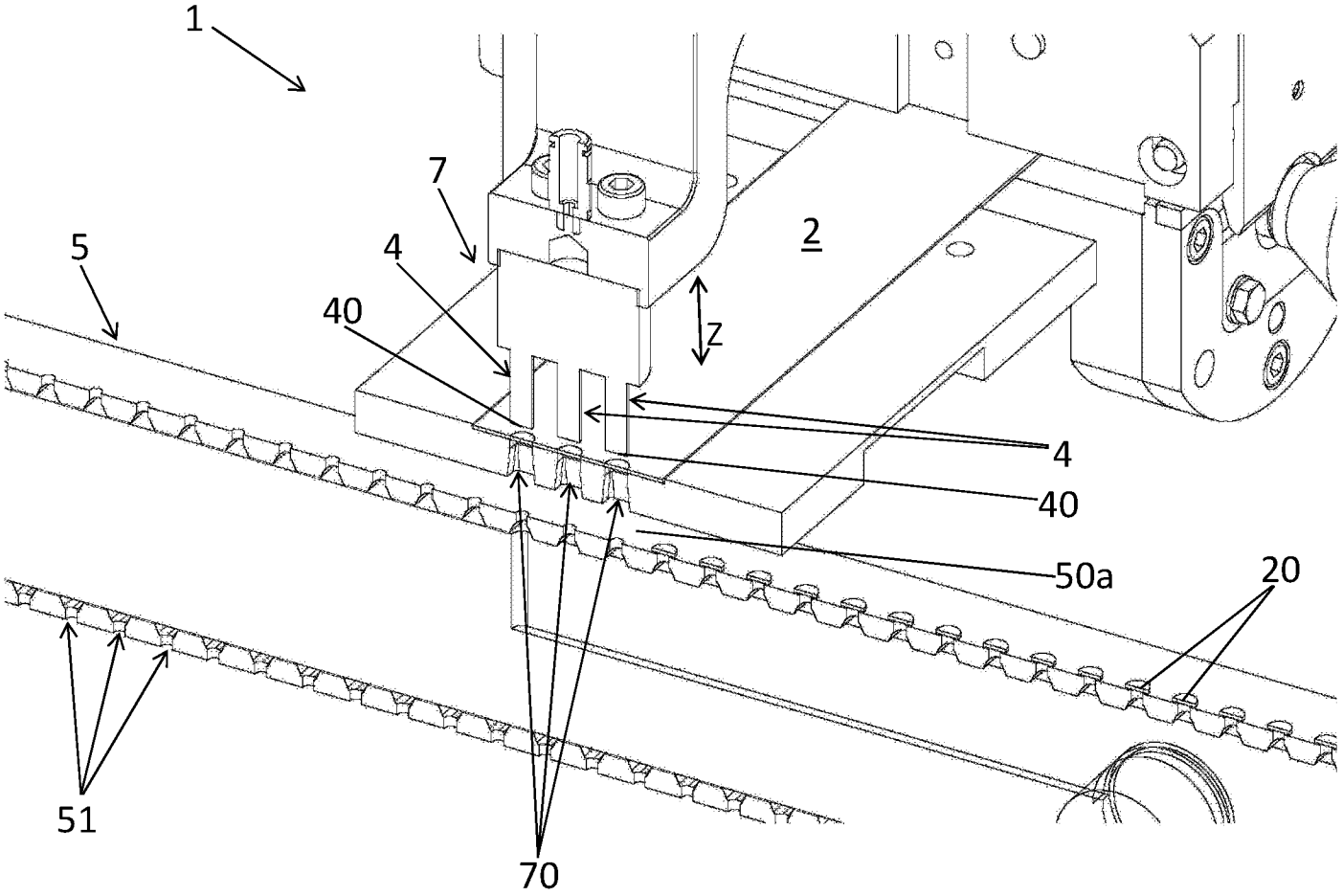
FIGS. 4-6 are enlarged cross-sectional views of the cutting unit of FIG. 2, each in a respective operating position of the cutting head 4.

With reference to FIG. 4, the substrate band 2 is stationary on the support plate 7 and three suction holes 51 of the conveyor belt 50 are each aligned with a respective cutting head 4 (and therefore are aligned with the through holes 70 of the support plate 7); the conveyor belt 50 is also stationary. The three cutting heads 4 face the substrate band 2; in detail, the corresponding cutting edge 40 is arranged near the substrate band 2. At this point, the three cutting heads 4 are moved along the movement direction Z until each substrate portion 20 is contacted and cut (cutting position of the cutting heads 4). Simultaneously with the cutting of the substrate band 2, the suction from the cutting head 4 is active so that each cutting head 4 will retain the respective substrate portion 20. Subsequent to the cutting, with reference to FIG. 5, the cutting heads 4 continue to move along the movement direction Z, each passing through a respective through hole 70 of the support plate 7 and retaining the substrate portion 20 by suction. The substrate band 2 and the conveying means 5 are always stationary. Thereafter, with reference to FIG. 6, the cutting heads 4 reach the release position B and release the substrate portions 20 at corresponding suction holes 51 of the conveyor belt 50: in this phase, the suction from the cutting heads 4 is stopped and the suction from the suction holes 51 is activated (alternatively, the suction holes 51 could have a greater suction power than that of the cutting heads 4). Lastly, the feed means 3 are activated so as to cause a predetermined portion of the substrate band 2 to be fed along the feed direction Y, the conveying means 5 are moved so as to move the substrate portions 20 towards the output section 6 and align three further suction holes 51 with the cutting heads 4. Moreover, the cutting heads 4 are further moved along the movement direction Z to bring them back to the initial position of FIG. 4. Subsequently, the cutting unit 1 resumes the working cycle.

Figure 7:
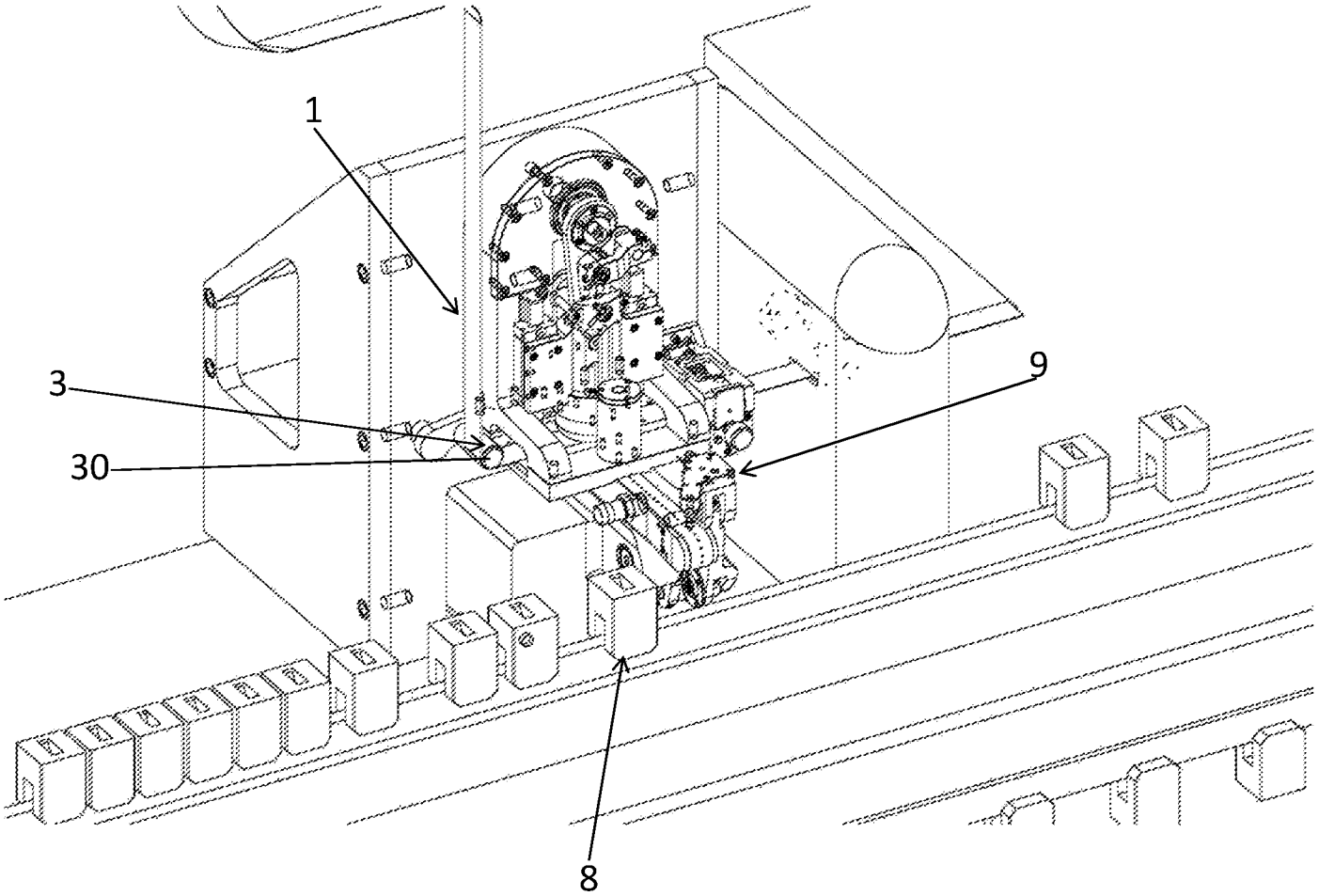
FIG. 7 is a perspective view of a cutting assembly according to the present invention.

A cutting assembly 100 for cutting a substrate band 2 for an aerosol-generating device—which is also an object of the present invention—is described below with reference to FIG. 7.

The cutting assembly 100 comprises: a cutting unit 1 in accordance with one of the aforesaid embodiments described above; an assembly unit 8 for assembling components (for example cartridges) of the aerosol-generating device; transferring means 9 arranged so as to transfer the substrate portion 20 from the output section 6 of the cutting unit 1 to the assembly unit 8.

This cutting assembly 100 allows easy and automatic transfer of the substrate portions 20 from the cutting unit 1 to an assembly unit 8.

The transferring means 9 may be of the pick and place type. In detail, these transferring means 9 may comprise a pick and place head 90, which is movable between a pick-up position in which it picks up (e.g. by suction) a substrate portion 20 from the output section 6 of the cutting unit 1, and a release position in which it places said substrate portion 20 at the assembly unit 8 (arranged downstream of the cutting unit 1).

The invention claimed is:

1. A cutting unit (1) for the cutting of a substrate band (2) made of a material suitable for carrying a liquid by capillary action and for an aerosol-generating device, wherein the substrate band (2) has a longitudinally-extending axis (X) and wherein the cutting unit (1) comprises:

feed means (3) for feeding the substrate band (2) along a feed direction (Y) parallel to the extension axis (X);

a cutting head (4) comprising a cutting edge (40) having a closed profile for cutting a substrate portion (20) from the substrate band (2), which cutting head (4) is movable in a movement direction (Z) transversal to the feed direction (Y) between a cutting position, in which it cuts the substrate portion (20), and a release position (A), in which it releases the substrate portion (20); and conveying means (5), which are arranged and shaped so as to receive the substrate portion (20) from the cutting head (4) when the cutting head (4) is in the release position (A), and convey the substrate portion (20) towards an output section (6), wherein:

when moved from the cutting position to the release position (A), the cutting head (4) retains the substrate portion (20);

wherein the cutting head (4) accompanies the substrate portion (20) to the conveying means (5) to rest, in the release position, the substrate portion (20) on the conveying means (5), wherein the cutting head (4) has suction action and is adapted to retain the substrate portion (20) in contact with an entirety of a surface of the cutting head disposed within the closed profile of the cutting edge when the cutting head is moved from the cutting position to the release position (A) so as to ensure a correct orientation of the substrate portion (2) on the conveying means (5), and wherein the conveying means comprises a conveyor belt (50) and the conveyor belt comprises a plurality of suction holes (51) arranged so that one of the suction holes (51) is aligned with the cutting head (4) when the cutting head (4) is in the release position (A).

2. The cutting unit (1) according to claim 1, comprising a support plate (7) for supporting the substrate band (2), which comprises a through hole (70) aligned with the cutting head (4) and sized so as to be passed through by the cutting head (4);

the support plate (7) being arranged between the substrate band (2) and the conveying means (5) so that the cutting head (4) passes through the through hole (70) when it is moved along the movement direction (Z).

3. The cutting unit (1) according to claim 2, wherein the transversal section of the through hole (70) has a profile with the same shape as the closed profile of the cutting edge (40).

4. The cutting unit (1) according to claim 1, wherein the conveyor belt (50) comprises a release segment (50*a*) at which it receives the substrate portion (20) from the cutting head (4);

the release segment (50*a*) extending in a plane orthogonal to the movement direction (Z) of the cutting head (4).

5. The cutting unit (1) according to claim 1, wherein the conveying means (5) convey the substrate portion (20) in a plane parallel to the substrate band (2) and in a conveying direction (W) transversal to the feed direction (Y) of the substrate band (2).

6. The cutting unit (1) according to claim 1, wherein the cutting edge (40) is circular or is a quadrilateral.

7. The cutting unit (1) according to claim 1, wherein the cutting head comprises a plurality of cutting heads (4), each comprising a respective cutting edge (40) having a closed profile for cutting a respective substrate portion (20) from the substrate band (2);

each cutting head (4) being movable in a movement direction (Z) parallel to the movement direction (Z) of the other cutting heads (4);

the conveying means (5) being arranged and shaped so as to receive the substrate portion (20) from each cutting head (4).

8. A cutting assembly (100) for cutting a substrate band (2) for an aerosol-generating device, comprising:

the cutting unit (1) according to claim 1;

an assembly unit (8) for assembling components of the aerosol-generating device; and transferring means (9) arranged and shaped so as to transfer the substrate portion (20) from the output section (6) of the cutting unit (1) to the assembly unit (8).

* * * * *